United States Patent [19]

Marder

[11] 4,112,790

[45] Sep. 12, 1978

[54] KNIFE SHARPENER

[75] Inventor: William Z. Marder, North Wales, Pa.

[73] Assignee: Zevco Enterprises, Inc., North Wales, Pa.

[21] Appl. No.: 744,588

[22] Filed: Nov. 24, 1976

[51] Int. Cl.[2] ..... B21K 5/12

[52] U.S. Cl. ..... 76/87

[58] Field of Search ..... 76/87, 82; 51/214

[56] References Cited

U.S. PATENT DOCUMENTS

| | | | |
|---|---|---|---|
| 469,615 | 2/1892 | Wardwell, Jr. | 76/87 |
| 540,944 | 6/1895 | Bold | 76/87 |
| 1,525,930 | 2/1925 | Graf | 76/87 |
| 1,600,613 | 9/1926 | Anderson | 76/87 |
| 3,289,498 | 12/1966 | Pleasants | 76/87 |

FOREIGN PATENT DOCUMENTS

| | | | |
|---|---|---|---|
| 511,596 | 9/1920 | France | 76/87 |

*Primary Examiner*—Harold D. Whitehead
*Assistant Examiner*—Roscoe V. Parker
*Attorney, Agent, or Firm*—Seidel, Gonda & Goldhammer

[57] ABSTRACT

The knife sharpener is comprised of a pair of cutting wheels carried for rotation by a supporting block. Each cutting wheel is rotatably journaled on an axle. Each axle has a bore extending therethrough. A fastener passes through the bores to secure the axles to the supporting block. At least one of the bores is eccentrically disposed within its axle. Rotation of the axle having the eccentric bore moves the rotational axis of the cutting wheel journaled thereon to adjust the clearance between the cutting wheels.

8 Claims, 4 Drawing Figures

KNIFE SHARPENER

BACKGROUND OF THE INVENTION

The present invention relates to apparatus for sharpening knives, scissors and the like. For relevant prior art, see U.S. Pat. Nos. 469,615; 540,944; 1,525,930; 1,600,613 and 3,289,489. Various types of knife sharpeners utilizing disks and/or cutting wheels are disclosed in the above-mentioned patents. It is believed that none of the knife sharpeners in said patents are constructed and operate in the unique manner of the present invention.

BRIEF SUMMARY OF THE INVENTION

The knife sharpener of the present invention is comprised of a support having a pair of axles attached thereto. A cutting wheel is journaled for rotary motion on each axle. At least one of the axles is eccentrically mounted in order to move the axis of rotation of its wheel toward the other wheel. Fastening means secure the axles to the support.

In the preferred embodiment, the features discussed hereinafter are utilized. Each axle has a bore therethrough. The bore of the axle which is eccentrically mounted is eccentrically located within the axle.

The axles are so disposed that the rotation of the axle with the eccentric bore can adjust the clearance between the cutting wheels. The position of the cutting wheel can be adjusted between a position wherein the circumferential surfaces of the cutting wheels are in rolling contact with one another and a position wherein a gap exists between the circumferential surfaces.

For proper sharpening, the cutting wheels should be in rolling contact with one another. In prior art sharpeners, critical machining of parts and extremely accurate methods of construction are required to attain this rolling contact. By utilizing the eccentric mounting of the axles, the criticality in construction is reduced. Also, in prior art sharpeners, once a cutting wheel becomes worn, the proper rolling contact between cutting wheels is lost and the sharpening capacity is reduced. The eccentric mounting of the axle of the present invention allows the position of the cutting wheels to be adjusted once the wheels become worn. In this manner, proper rolling contact between the cutting wheels is maintained.

Each axle is formed in two sections having different effective diameters or different transverse dimensions. The cutting wheels are journaled about the smaller diameter sections of the axles and have one of their major faces resting upon an end face of the sections having the larger diameter. The other end face of the section with the larger diameter abut the supporting block. With a cutting wheel journaled about a small diameter section and resting upon an end face of a large diameter section, the small diameter section projects beyond the adjacent area of the outer major face of the cutting wheel. A fastening means thus contacts the smaller diameter section of the axle and not the cutting wheel. Thus, the fastening means do not prevent rotation of the cutting wheels.

The supporting block has three major faces which interconnect to form a block having a triangular cross section. The cutting wheels and axles are mounted to one of the major faces. A pair of slots are cut into the supporting block and are disposed on either side of a line through the axes of the cutting wheels. The slots form guides through which a knife being sharpened is moved.

It is an object of the invention to provide a knife sharpener utilizing a pair of rotatable cutting wheels.

Another object of the invention is to provide an inexpensive and reliable means for adjusting the clearance between the cutting wheels.

Another object of the invention is to provide a knife sharpener which cuts rather than grinds the knives being sharpened.

A further object of the invention is to provide a small and compact knife sharpener which can be easily used by both right-handed and left-handed persons.

Other objects will appear hereinafter.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
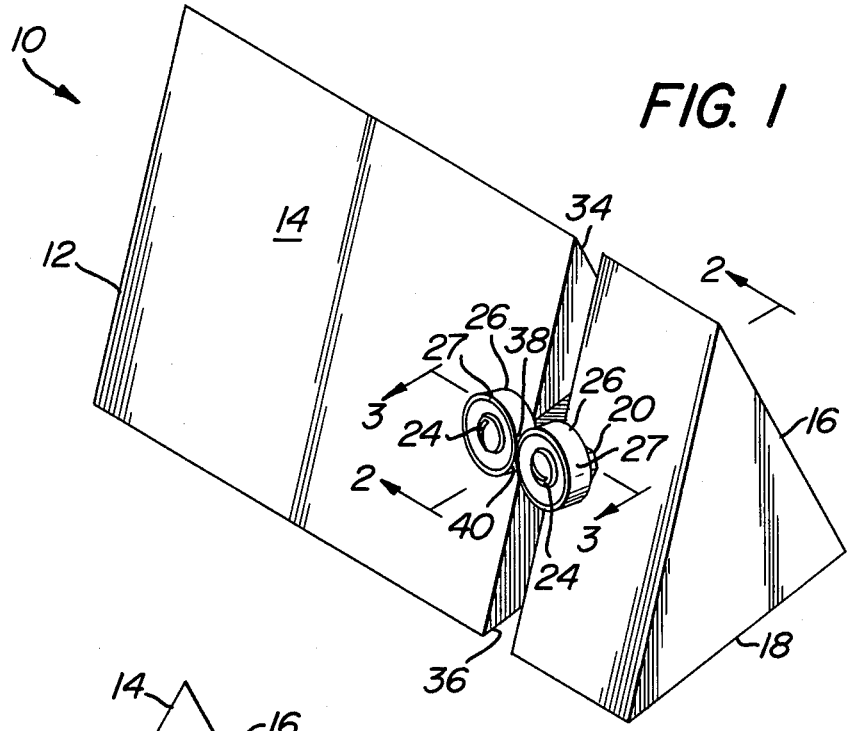
FIG. 1 is a perspective view of a knife sharpener in accordance with the present invention.
Figure 2:
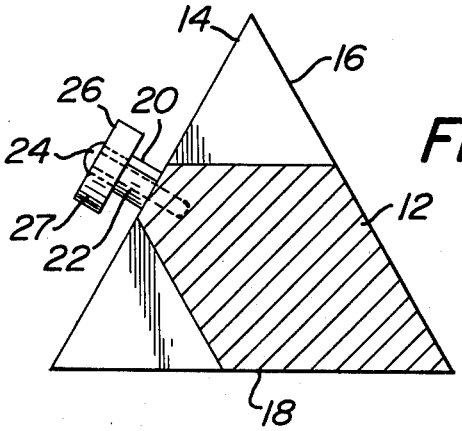
FIG. 2 is a sectional view taken along line 2—2 of FIG. 1.

Referring to the drawing in detail, wherein like numerals indicate like elements, there is shown a knife sharpener in accordance with the present invention designated generally as 10.

The knife sharpener 100 includes a supporting block 12, which has three major faces or surfaces 14, 16 and 18 interconnected to form a triangular cross section. The supporting block 12 can be made of any suitable sturdy material. In the preferred embodiment, however, the block 12 is made of cast aluminum.

A pair of axles 20 are removably secured to the block 12 on the surface 14. Each axle 20 has a bore 22 extending therethrough. A cutting wheel 26 is rotatably carried by each axle 20. A screw 24 passes through each bore 22 and threads into a blind hole in block 12 to thereby secure the axles 20 and cutting wheels 26 to the block 12. While other suitable materials can be used, in the preferred embodiment, the axles 20 are made of stainless steel and the cutting wheels 26 are made of tunsten carbide.

Each axle 20 includes a section 28 and a section 30. The transverse dimension of the sections 28 is greater than the transverse dimension of the sections 30. One end face of the sections 28 abuts the surface 14 and the other end face of the sections 28 is integral with the section 30. The sections 28 are polygonal in cross section, such as a hexagon 29. The sections 30 are circular in cross section. The reason for shaping the sections 28 as hexagons 29 will be explained hereinafter. Each section 30 passes through a centrally disposed hole 32 within a cutting wheel 26. The diameter of the holes 32 is larger than the diameter of the sections 30 but smaller than the transverse dimension of the sections 28. The cutting wheels 26 are thus journaled for rotation about sections 30 and have one of their major faces resting upon the end faces 34.

The axial length of the sections 30 is greater than the thickness of the cutting wheels 26 in the area adjacent to the sections 30. In this manner, when the cutting wheels 26 are journaled about the sections 30 and rest upon the surfaces 34, the screws 24 will tighten down onto an end of the sections 30 without contacting the cutting wheels 26.

Figure 3:
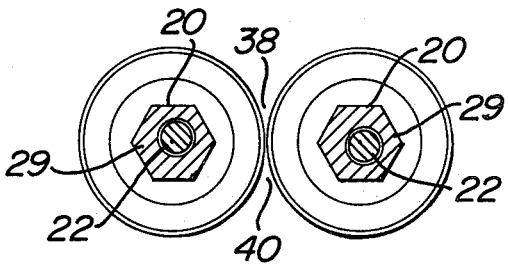
FIG. 3 is a sectional view taken along line 3—3 of FIG. 1.
Figure 4:
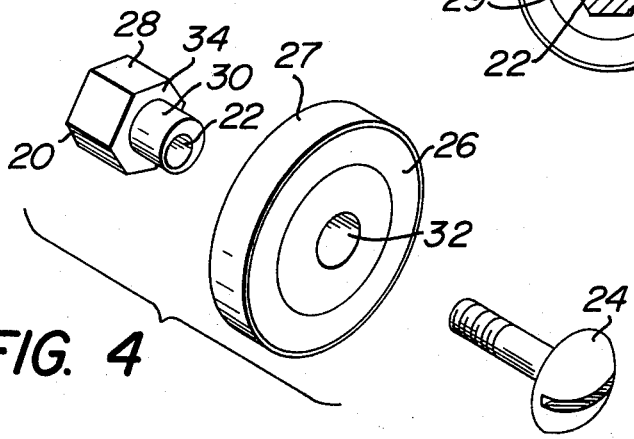
FIG. 4 is an exploded perspective view, on an expanded scale, of the axle, cutting wheel and fastener.

At least one of the bores 22 is eccentrically disposed with respect to the central axis of its axle 20. As shown in FIG. 3, both axles 22 may be eccentrically disposed. By rotating an axle 20 about its eccentric bore 22, the axis of rotation of the cutting wheel carried by the axle moves in a direction parallel with the surface 14. In this manner, the distance between the axes of rotation of the cutting wheels 26 and the clearance between the cutting wheels 26 can be adjusted.

The bores 22, as illustrated, are eccentrically disposed with respect to both sections 28 and 30. The movement of the axis of rotation of the cutting wheels can also be attained by having the bores 22 eccentrically disposed with respect to only the sections 30 while being concentrically disposed within sections 28.

The axles 20 are so disposed on the surface 14 that the rotation of an axle 20 about its eccentric bore 22 can move a cutting wheel 26 carried thereon between a position wherein circumferential surfaces 27 of the cutting wheels 26 are in firm contact with one other and a position wherein a gap exists between the circumferential surfaces 27. Once the desired location of a cutting wheel 26 is selected, a screw 24 is tightened down to thereby secure an axle 20 to a fixed rotative position.

To change the position of a cutting wheel 26, the hexagon 29 of an axle 20 with an eccentric bore 22 is grasped with a tool, such as a wrench or pliers, and the fastening screw 24 is loosened. Thereafter, the axle 20 can be rotated until its cutting wheel 26 is in the desired location. The screw 24 is then re-tightened while the wrench or pliers hold the axle 20 in position by grasping the hexagon section 29.

A pair of slots 34, 36 are cut out of the block 12. As seen in FIG. 1, the slot 34 is disposed above a line through the axes of the cutting wheels 26, while the slot 36 is disposed below such a line. As will be explained hereinafter, the slots 34, 36 permit both right-handed and left-handed persons to easily use the knife sharpener 10.

In use, the cutting wheels 26 are adjusted so that their circumferential surfaces are in rolling contact with one another by adjusting the rotative position of an axle 20 having an eccentric bore 22. A nip 38 is thus formed between the cutting wheels 26 adjacent the slot 34 and a nip 40 is formed between the cutting wheels 26 adjacent the slot 36. As shown in FIG. 1, the knife sharpener 10 is set up for use by a right-handed person. The cutting wheels 26 are facing forward on the right side of face 14 and a large portion of the block 12 extends to the left of the cutting wheels 26. A right-handed person can thus grasp the left portion of knife sharpener 10 with his left hand and use his right hand to hold the knife to be sharpened.

The tip of a knife to be sharpened is placed within the nip 38 and the knife is moved forwardly into the slot 34 while keeping the knife edge being sharpened within the nip 38. The cutting wheels 26 are disposed at an angle with respect to the horizontal and the knife being sharpened is kept horizontal while it is moved through the nip 38. In this manner, the forward edges of the cutting wheels 26 cut the knife blade in order to sharpen it. The horizontal motion of a knife blade through the nip 38 also causes the cutting wheels 36 to rotate slightly. This rotation causes a slicing effect which helps to cut the material from the knife's edge. This rotary motion also removes chips of material out of the way so that they do not interfere with the knife sharpening. The knife is moved through the nip 38 only in the one direction into the slot 34. This operation is continued until the knife is sharpened to the desired degree.

When the knife sharpener 10 is to be used by a left-handed person, the knife sharpener 10 is supported on the surface 16 instead of the surface 18, as shown in FIG. 1. The cutting wheels 26 are thereby placed on the left end of the knife sharpener 10 and the large portion of the block 12 extends to the right. The nip 40 and the slot 36 are uppermost in this disposition and the knife to be sharpened is moved forwardly through the nip 40 into the slot 36.

The present invention may be embodied in other specific forms without departing from the spirit or essential attributes thereof and, accordingly, reference should be made to the appended claims, rather than to the foregoing specification as indicating the scope of the invention.

What is claimed is:

1. A knife sharpener comprising:

a support;

a pair of axles attached to said support, each axle including a first section and a second section, the transverse dimension of said second section being less than the transverse dimension of said first section;

a discrete cutting wheel having a bore journaled on the second section of each axle for rotary motion during the sharpening of a knife, the axis length of said second section being greater than the thickness of the blade at the bore;

means including a wrench engaging surface on the outer periphery of said first section for providing an eccentric mounting for at least one wheel for moving the axis of rotation of said one wheel toward the other wheel;

fastening means for securing the first section of said axles to said support in a fixed rotative position without applying axially directed pressure to said cutting wheels;

said cutting wheels being supported adjacent one another with their outer periphery in rolling contact and forming between them a means for cutting an edge of a knife being sharpened.

2. A knife sharpener in accordance with claim 1 wherein each axle has a bore extending therethrough and said eccentric mounting means includes at least one of said bores being eccentrically disposed within its axle.

3. A knife sharpener in accordance with claim 2 wherein said fastening means includes screws passing through said bores, threading into said support and contacting an end of said axles without exerting pressure on said wheels.

4. A knife sharpener in accordance with claim 2 wherein said axles are disposed on said support such that the rotation of said axle having the eccentric bore can move the cutting wheels between a position wherein their circumferential surfaces are in rolling contact with one another and a position wherein a gap exists between said circumferential surfaces.

5. A knife sharpener in accordance with claim 1 wherein said fastening means contacts an end of a second section without contacting the cuttin wheel journaled thereon whereby the rolline contact between said cutting wheels forms the only force restricting the rotation of said wheels about said axles.

6. A knife sharpener in accordance with claim 1 wherein said wrench engaging surface is in the form of a polygon.

7. A knife sharpener in accordance with claim 1 wherein said support is a supporting block having three major faces interconnected to form a triangular cross section.

8. A knife sharpener in accordance with claim 7 wherein said axles are supported on one of said major faces and a pair of slots extend through said block one slot on either side of a line passing through the axes of said wheels.

* * * * *